US007478463B2

(12) United States Patent
Conner

(10) Patent No.: US 7,478,463 B2
(45) Date of Patent: Jan. 20, 2009

(54) MANUFACTURING PROCESS FOR COMBINING A LAYER OF PULP FIBERS WITH ANOTHER SUBSTRATE

(75) Inventor: J. Michael Conner, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 563 days.

(21) Appl. No.: 11/235,700

(22) Filed: Sep. 26, 2005

(65) Prior Publication Data

US 2007/0067973 A1 Mar. 29, 2007

(51) Int. Cl.
*D04H 5/02* (2006.01)

(52) U.S. Cl. ..... 28/104; 28/105

(58) Field of Classification Search ..... 28/104, 28/105, 167, 103, 116, 138; 26/18.6; 162/202–207, 162/289, 111, 290, 300, 348, 217, 133, 115, 162/109; 156/148; 19/66 R, 296, 304, 308, 19/302

See application file for complete search history.

(56) References Cited

U.S. PATENT DOCUMENTS

| | | | | |
|---|---|---|---|---|
| 2,666,369 | A | 1/1954 | Niks | |
| 3,485,706 | A | 12/1969 | Evans | |
| 3,821,068 | A | 6/1974 | Shaw | |
| 4,755,421 | A | 7/1988 | Manning et al. | |
| 4,808,467 | A | 2/1989 | Suskind et al. | |
| 4,902,564 | A | 2/1990 | Israel et al. | |
| 4,970,104 | A | 11/1990 | Radwanski | |
| 5,009,747 | A | 4/1991 | Viazmensky et al. | |
| 5,137,600 | A | 8/1992 | Barnes et al. | |
| 5,144,729 | A | 9/1992 | Austin et al. | |
| 5,254,399 | A | 10/1993 | Oku et al. | |
| 5,284,703 | A | 2/1994 | Everhart et al. | |
| 5,389,202 | A | 2/1995 | Everhart et al. | |
| 5,397,437 | A | 3/1995 | Ingemar | |
| 5,573,841 | A | 11/1996 | Adam et al. | |
| 5,593,533 | A * | 1/1997 | Groshens | 28/105 |

(Continued)

FOREIGN PATENT DOCUMENTS

| | | |
|---|---|---|
| WO | 9932716 | 7/1999 |

(Continued)

OTHER PUBLICATIONS

PCT Search Report—May 7, 2007.

*Primary Examiner*—Amy B Vanatta
(74) *Attorney, Agent, or Firm*—Dority & Manning, P.A.

(57) ABSTRACT

A process for hydro-entangling a layer of fibers into a web includes the steps of conveying a web from a supply to lie against a traveling hydro-entangling fabric. A layer of fibers is deposited onto a traveling forming fabric, the forming fabric supporting the fiber layer from below. The forming fabric and the hydro-entangling fabric converge at a combining location where the forming fabric and hydro-entangling fabric orient and travel adjacent each other such that the fiber layer and web are sandwiched between the forming fabric and the hydro-entangling fabric with the fiber layer supported from below by the hydro-entangling fabric and web. The forming fabric is separated from the fiber layer after the web and overlying fiber layer are supported from below by the hydro-entangling fabric and the hydro-entangling fabric is conveyed through a hydro-entangling station to hydro-entangle the fibers into the web.

23 Claims, 4 Drawing Sheets

U.S. PATENT DOCUMENTS

| | | | | |
|---|---|---|---|---|
| 5,814,178 | A | 9/1998 | Jacobs | |
| 5,935,880 | A | 8/1999 | Wang et al. | |
| 5,960,525 | A * | 10/1999 | Fleissner | 28/104 |
| 5,990,377 | A | 11/1999 | Chen et al. | |
| 6,007,653 | A * | 12/1999 | Pirinen et al. | 28/104 |
| 6,022,818 | A | 2/2000 | Welchel et al. | |
| 6,058,583 | A * | 5/2000 | Takeuchi et al. | 28/104 |
| 6,103,061 | A | 8/2000 | Anderson et al. | |
| 6,110,848 | A | 8/2000 | Bouchette | |
| 6,177,370 | B1 | 1/2001 | Skoog et al. | |
| 6,375,773 | B1 * | 4/2002 | Andersen | 156/148 |
| 6,381,817 | B1 | 5/2002 | Moody, III | |
| 6,395,957 | B1 | 5/2002 | Chen et al. | |
| 6,412,155 | B2 * | 7/2002 | Fleissner | 28/104 |
| 6,454,904 | B1 * | 9/2002 | Hermans et al. | 162/205 |
| 6,479,009 | B1 | 11/2002 | Zlatkus | |
| 6,516,502 | B1 | 2/2003 | Moody, III | |
| 6,673,204 | B2 * | 1/2004 | Takai et al. | 28/104 |
| 6,739,023 | B2 | 5/2004 | Vonfeldt et al. | |
| 6,782,589 | B2 | 8/2004 | Ngai | |
| 6,911,573 | B2 | 6/2005 | Chen et al. | |
| 7,278,187 | B2 * | 10/2007 | Petersen | 19/302 |
| 2002/0034914 | A1 | 3/2002 | De Leon et al. | |
| 2002/0177379 | A1 | 11/2002 | Abed et al. | |
| 2003/0207636 | A1 | 11/2003 | Gosavi et al. | |
| 2003/0211800 | A1 | 11/2003 | Duncan et al. | |
| 2003/0213108 | A1 | 11/2003 | Strandqvist | |
| 2003/0217448 | A1 * | 11/2003 | Andersen | 28/104 |
| 2004/0010895 | A1 | 1/2004 | Vonfeldt et al. | |
| 2005/0022954 | A1 | 2/2005 | Strandqvist | |
| 2005/0091811 | A1 * | 5/2005 | Billgren | 28/104 |
| 2005/0092417 | A1 | 5/2005 | Billgren et al. | |
| 2005/0112980 | A1 | 5/2005 | Stranqvist et al. | |
| 2006/0080816 | A1 * | 4/2006 | Noelle | 28/116 |

FOREIGN PATENT DOCUMENTS

| | | | |
|---|---|---|---|
| WO | 2005042822 | A1 | 5/2005 |
| WO | 2005065929 | A1 | 7/2005 |

* cited by examiner

MANUFACTURING PROCESS FOR COMBINING A LAYER OF PULP FIBERS WITH ANOTHER SUBSTRATE

BACKGROUND

With certain manufacturing processes, it is necessary to convey fibrous webs or layers to various stages for further processing or to be combined with other substrates. For example, certain types of desirable composite materials are made by combining pulp fibers with other substrates, including nonwoven spunbonded webs, meltblown webs, scrim materials, and other textile materials. One known technique for combining these materials is by hydraulic entangling. For example, U.S. Pat. No. 4,808,467 discloses a high-strength nonwoven fabric made of a mixture of wood pulp and textile fibers entangled with a continuous filament base web. U.S. Pat. No. 5,389,202 describes a high pulp content composite fabric formed by hydraulically entangling a web of pulp fibers into a continuous filament substrate.

In a typical manufacturing process for hydraulically entangling a layer of fibers into a nonwoven web, the nonwoven material travels in a machine direction on a mesh belt or fabric to a hydraulic entangling station. A dilute suspension containing fibers (pulp, synthetic, or a combination of both) is supplied by a head box and deposited via a sluice onto a forming fabric of a conventional paper-making machine. Water is removed from the fiber suspension to form a uniform layer of fibers on the forming fabric. After being formed, the layer is conveyed in the machine direction and laid onto the nonwoven web. The nonwoven web and overlying fiber layer are conveyed under one or more hydraulic entangling manifolds wherein jets of fluid entangle the fibers into and through the nonwoven substrate to form a composite material. Vacuum slots may be located beneath or downstream of the water jet manifolds to remove excess water from the composite material. After the fluid jet treatment, the composite fabric is conveyed through a non-compressive drying operation, for example a conventional rotary drum through-air drying apparatus.

Regardless of the process, the fiber layer or webs must either have substantial strength so as to maintain their integrity, or be supported by external means or an additional substrate. For example, with a conventional hydro-entangling process, the fiber layer is typically conveyed as a sheet unsupported over at least some distance prior to being combined with the nonwoven substrate. This situation requires the fiber sheet to have substantial strength so as not to loose sheet integrity, particularly in the unsupported locations. In particular, the fiber sheet must have an increased basis weight and include fibers having substantial wet strength characteristics. Processing machine speed is often limited by the fiber sheet characteristics to ensure sheet integrity. However, despite careful attention to the fiber sheet characteristics, it is often the case that the fiber sheet breaks, particularly in the unsupported areas. This results in the loss of valuable production time.

System configurations are known for fully supporting a pulp sheet from a forming section to a dryer section wherein the sheet is supported from below by the former belt, transferred to an intermediate differential speed belt where the sheet is supported from above, and then transferred again to the dryer belt where the sheet is supported from below. It is also known to use this arrangement for transferring a fibrous web from a forming belt to a hydro-entangling belt. However, with such systems, the multiple transfer of the fibrous web or sheet between belts requires complex machinery and can be detrimental in that creases or density variances are created in the sheet or web by the transfer belts.

SUMMARY

Various objects and advantages of the invention will be set forth in part in the following description, or may be apparent from the description, or may be learned from practice of the invention.

In a general aspect, process embodiments according to the invention may be used to convey a fiber layer or other inherently weak web or material between processing stations. The invention is not limited to any particular type of fibers, web, or intended processing steps. For purposes of explanation only, the process will be explained in the context of conveying a fiber layer.

Although not limited to any particular purpose, the process is particularly suited for transferring a fiber layer from a forming belt to a traveling fabric of a hydro-entangling station. The fiber layer may be subsequently entangled, or entangled with another substrate to form a composite material, such as a layer of pulp fibers hydro-entangled into a nonwoven web. The inventive process provides distinct advantages over many types of conventional systems in that the system is relatively simple and does not require transfer of the fiber layer or web multiple times. Also, the significance of the fiber layer characteristics is greatly minimized. Hydro-entangled materials may be made with fiber layers having a lower basis weight and formed of more diverse types of fibers, including fibers having decreased wet strength characteristics as compared to conventional processes. With the present inventive manufacturing process, machine processing speed is less likely to be constrained by the fiber layer characteristics.

The process includes conveying a layer of fibers on a first traveling belt such that the fiber layer is fully supported from below by the first belt. The first belt may be a forming fabric onto which a slurry of fibers is initially deposited. For example, the fiber layer may include pulp fibers deposited onto a forming fabric directly from a head box. The direction of travel of the first belt converges with a second belt at a combining location where the first belt and second belt merge such that the fiber layer is sandwiched between the first belt and second belt. In a particular embodiment, the first belt conveys the fiber layer from a location below and forward of the convergence location with respect to a processing machine direction. After merging, the relative position of the belts is re-oriented such that the second belt is disposed below the fiber layer. The belts may travel together in this orientation over a defined distance before the first belt is diverted away and separated from the second belt. The fiber layer is fully supported by the second belt and conveyed for further processing.

In a particular embodiment, the second belt is a hydro-entangling fabric and the fiber layer is conveyed to a hydro-entangling station and entangled to form a nonwoven web.

To aid in separating the first belt from the second belt, the merged belts may be conveyed over a vacuum source that pulls the fiber layer away from the first belt and against the second belt. A hydro-entangling manifold may be used in combination with the vacuum source to aid in separation of the fiber layer from the first belt.

Embodiments of the process may be particularly well suited for hydro-entangling processes wherein a fiber layer having relatively little structural integrity, such as a pulp layer deposited onto a forming fabric, is entangled with another substrate, such as a nonwoven web. The process may include, for example, the step of conveying a nonwoven web from a supply, such as a conventional roll supply station, to a traveling hydro-entangling fabric for further conveyance and processing. A layer of fibers is formed by known means, such as with a conventional head box system, and is conveyed by a forming fabric to the nonwoven web. The fiber layer is transferred onto the nonwoven web so as to overlie the web. From formation to transfer onto the nonwoven web, the fiber layer is fully supported from below so that there is little possibility of the layer losing integrity prior to being deposited onto the web. After the fiber layer has been transferred and is fully supported by the nonwoven web and hydro-entangling fabric, the fiber layer and web combination are conveyed through a hydro-entangling station wherein the fibers are hydro-entangled into the nonwoven web. From the hydro-entangling station, the composite material may be conveyed to any manner of conventional drying station, typically a non-compressive drying apparatus.

In a particular embodiment, the nonwoven web is supplied directly from a supply roll to the hydro-entangling fabric, and the fiber layer is deposited as slurry onto the traveling forming fabric. The traveling path of the forming fabric and hydro-entangling fabric (with nonwoven web) converge at a combining location and then travel adjacent each other over a defined distance with the fiber layer and nonwoven web sandwiched between the forming fabric and the hydro-entangling fabric. Prior to the hydro-entangling station, the forming fabric is separated from the fiber layer, but not before the fiber layer is fully supported from below by the nonwoven web and hydro-entangling fabric.

After converging together at the combining location, the hydro-entangling fabric and forming fabric may travel adjacent each other over the defined distance in a machine direction. Prior to merging with the forming fabric at the combining location, the nonwoven web may be directed against the hydro-entangling fabric at a location where the hydro-entangling fabric travels in a direction other than the machine direction, for example in a generally opposite direction. After merging, the forming fabric (with fiber layer supported thereon) and the hydro-entangling fabric change direction to the machine direction and re-orient such that the relative position of the forming fabric with respect to the fiber layer reverses and the forming fabric is disposed above the fiber layer, but only after the hydro-entangling fabric is disposed below the fiber layer and fully supports the fiber layer and nonwoven web.

In a particular embodiment, a combining roll defines the combining location, with the forming fabric and hydro-entangling fabric traveling together around at least a portion of the combining roll.

The fiber layer may be deposited onto the forming fabric at a location below the combining location such that the fiber layer is conveyed in an angled vertical direction to the combining location while fully supported by the forming fabric. At the combining location, the fiber layer is placed against the nonwoven web and the combination of materials is sandwiched between the forming fabric and hydro-entangling fabric. The sandwiched configuration is conveyed together and re-oriented so that the hydro-entangling fabric is disposed below and fully supports the fiber layer and nonwoven web, at which point the forming fabric may be separated from the fiber layer.

The forming fabric may be separated from the fiber layer by various means, including diverting the direction of travel of the forming fabric away from the hydro-entangling fabric. Suction from a vacuum source may be applied through the hydro-entangling fabric to draw the fiber layer against the nonwoven web as the forming fabric is diverted away. It may also be desired to use a hydro-entangling manifold in combination with the vacuum source to aid in separation of the fiber layer from the forming fabric.

Aspects of the invention will be described in greater detail below by reference to particular embodiments depicted in the drawings.

DETAILED DESCRIPTION

Figure 1:
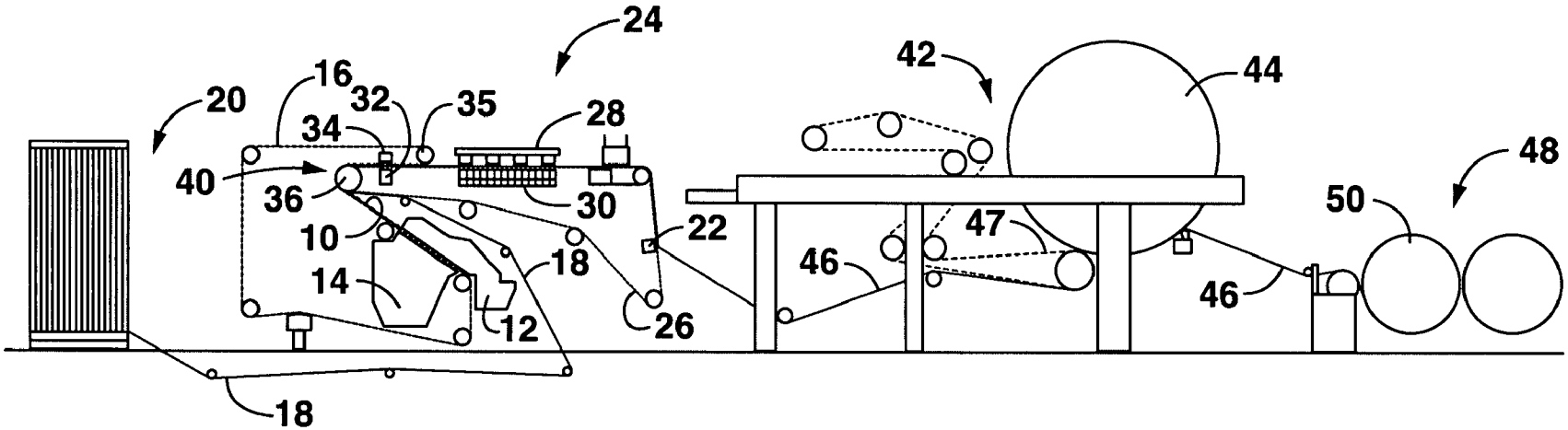
FIG. 1 is a machine layout view of a manufacturing line incorporating aspects of the process according to the invention.

Reference will now be made in detail to embodiments of the invention, one or more examples of which are illustrated in the drawings. Each example is provided by way of explanation of the invention, and is not meant as a limitation of the invention. For example, features illustrated or described as part of one embodiment can be used with another embodiment to yield still a third embodiment. It is intended that the present invention include these and other modifications and variations.

As mentioned, in a general aspect, the present invention provides a process for conveying a fiber layer or web to any manner of processing station. The particular type of fiber is not a limitation of the invention. The fibers may be, for example, any combination of synthetic or pulp staple length fibers. The selected average fiber length and denier will generally depend on a variety of factors and desired processing steps. For hydro-entangling, the average fiber length of the staple fibers is generally low enough so that a portion of an individual fiber may readily entangle with continuous filaments of a nonwoven web, and also long enough so that another portion of the fiber is able to protrude therethrough. In this regard, the staple fibers typically have an average fiber length in the range of from about 0.3 to about 25 millimeters, in some embodiments from about 0.5 to about 10 millimeters, and in some embodiments, from about 4 to about 8 millimeters. The denier per filament of the staple fibers may also be less than about 6, in some embodiments less than about 3, and in some embodiments, from about 0.5 to about 3.

A majority of the staple fibers utilized may be synthetic. Some examples of suitable synthetic staple fibers include, for instance, those formed from polymers such as, polyvinyl alcohol, rayon (e.g., lyocel), polyester, polyvinyl acetate, nylon, polyolefins, etc. The synthetic staple fibers may also be monocomponent and/or multicomponent (e.g., bicomponent). For example, suitable configurations for the multicomponent fibers include side-by-side configurations and sheath-core configurations, and suitable sheath-core configurations include eccentric sheath-core and concentric sheath-core configurations. In some embodiments, as is well known in the art, the polymers used to form the multicomponent fibers have sufficiently different melting points to form different crystallization and/or solidification properties.

A substantial portion of the staple fibers may be cellulosic pulp fibers. Pulp fibers may be utilized to reduce costs, as well as impart other benefits to the composite fabric, such as improved absorbency. Some examples of suitable cellulosic fiber sources include virgin wood fibers, such as thermomechanical, bleached and unbleached pulp fibers. Pulp fibers may have a high-average fiber length, a low-average fiber length, or mixtures of the same. Some examples of suitable high-average length pulp fibers include northern softwood, southern softwood, redwood, red cedar, hemlock, pine (e.g., southern pines), spruce (e.g., black spruce), combinations thereof, and so forth. Some examples of suitable low-average fiber length pulp fibers may include certain virgin hardwood pulps and secondary (i.e. recycled) fiber pulp from sources such as, for example, newsprint, reclaimed paperboard, and office waste. Hardwood fibers, such as eucalyptus, maple, birch, aspen, and so forth, may also be used as low-average length pulp fibers. Mixtures of any of the above types of fibers may also be used.

Figure 2:
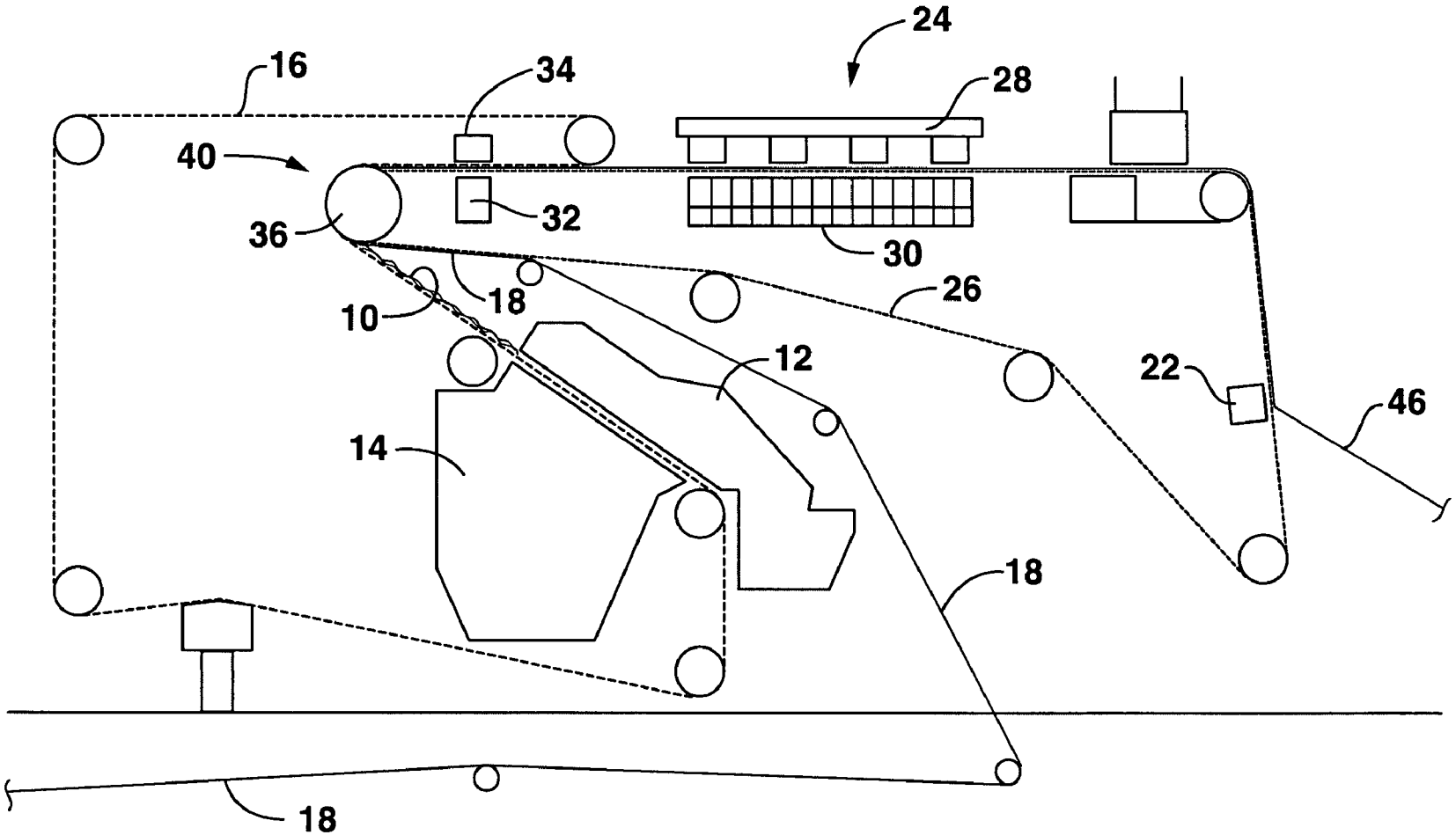
FIG. 2 is a more detailed view of a section of the manufacturing line from FIG. 1 particularly illustrating the process steps of transferring the pulp layer onto the hydro-entangling fabric in accordance with one embodiment of the invention.

Although not limited to such a use, embodiments of the invention are particularly well suited for hydro-entangling lines wherein a fiber layer in entangled with another substrate, such as a nonwoven web. In this regard, FIGS. 1 and 2 illustrate a manufacturing line for forming a composite material by hydro-entangling fibers into a nonwoven web. An aqueous suspension of fibers is deposited onto a forming fabric 16 by a conventional head box 12. A vacuum box 14 is configured with the head box 12 to at least partially de-water the slurry through the forming fabric 16 such that a uniform pulp layer 10 is formed on the fabric 16 and conveyed towards a hydro-entangling station 24.

The suspension of fibers may be diluted to any consistency that is typically used in conventional papermaking processes. For example, the suspension may contain from about 0.01 to about 1.5 percent by weight fibers suspended in water. Water is removed from the suspension of fibers by the vacuum box 14 to form the uniform layer 10 of fibers. The fibers may be any high-average fiber length, low-average fiber length, or mixtures of the same. For pulp fibers, the high-average fiber length typically has an average fiber length from about 1.5 mm to about 6 mm. The low-average fiber length pulp may be, for example, certain virgin hardwood pulps and secondary (i.e. recycled) fiber pulp from sources such as, for example, newsprint, reclaimed paperboard, and office waste. The low-average fiber length pulps typically have an average fiber length of less than about 1.2 mm, for example, from 0.7 mm to 1.2 mm. Mixtures of high-average fiber length and low-average fiber length pulps may contain a significant proportion of low-average fiber length pulps. For example, mixtures may contain more than about 50 percent by weight low-average fiber length pulp and less than about 50 percent by weight high-average fiber length pulp. One exemplary mixture contains 75 percent by weight low-average fiber length pulp and about 25 percent high-average fiber length pulp.

The fibers may be unrefined or may be beaten to various degrees of refinement. Small amounts of wet-strength resins and/or resin binders may be added to improve strength and abrasion resistance. Useful binders and wet-strength resins are well known to those skilled in the art. Debonding agents may be added to the pulp mixture to reduce the degree of hydrogen bonding if a very open or loose nonwoven pulp fiber web is desired. The addition of certain debonding agents in the amount of, for example, 0.1 to 4.0 percent, by weight, of the composite also appears to reduce the measured static and dynamic coefficients of friction and improve the abrasion resistance of the continuous filament rich side of the composite fabric. The de-bonder is believed to act as a lubricant or friction reducer.

A web 18 is supplied to the hydro-entangling station 24 from a supply station 20. This web 18 may be a meltblown web, spunbond web, bonded carded web, air laid or wet laid bonded web, a woven web of natural or synthetic fibers, a knitted web, perforated film, and so forth. It should be appreciated that the type of web 18 is not a limitation of the present inventive process. Typically, the web 18 is unwound from one or more supply rolls at the supply station 20, but may also be formed directly at the supply station 20.

In a typical process the web 18 is a nonwoven web that may be formed by known continuous filament nonwoven extrusion processes, such as, for example, known solvent spinning or melt-spinning processes, and passed directly onto a transport belt without first being stored on a supply roll. The nonwoven web 18 may be a web of continuous melt-spun filaments formed by the spunbond process. The spunbond filaments may be formed from any melt-spinnable polymer, co-polymers or blends thereof. For example, the spunbond filaments may be formed from polyolefins, polyamides, polyesters, polyurethanes, A-B and A-B-A' block copolymers where A and A' are thermoplastic endblocks and B is an elastomeric midblock, and copolymers of ethylene and at least one vinyl monomer such as, for example, vinyl acetates, unsaturated aliphatic monocarboxylic acids, and esters of such monocarboxylic acids. If the filaments are formed from a polyolefin such as, for example, polypropylene, the nonwoven web 18 may have a basis weight from about 3.5 to about 70 grams per square meter (gsm). More particularly, the nonwoven substrate 20 may have a basis weight from about 10 to about 35 gsm. The polymers may include additional materials such as, for example, pigments, antioxidants, flow promoters, stabilizers and the like.

The nonwoven web 18 will generally have a total bond area of less than about 30 percent and a uniform bond density greater than about 100 bonds per square inch. For example, the nonwoven continuous filament substrate may have a total bond area from about 2 to about 30 percent (as determined by conventional optical microscopic methods) and a bond density from about 250 to about 200 pin bonds per square inch. Various bonding techniques are well known in the art, such as pin bonding or any form of bonding that produces good tie down of the filaments with minimum overall bond area. For example, a combination of thermal bonding and latex impregnation may be used to provide desirable filament tie down with minimum bond area. Alternatively and/or additionally, a resin, latex or adhesive may be applied to the nonwoven continuous filament web by, for example, spraying or printing, and dried to provide the desired bonding.

By process steps described in greater detail below, the fiber layer 10 is eventually laid on the web 18, with the combination of fiber layer 10 and web 18 supported on a traveling hydro-entangling fabric 26 of a conventional hydraulic entangling machine 24. The fiber layer 10 and web 18 pass under one or more hydraulic entangling manifolds 28 and are treated with jets of fluid to entangle the fibers with the filaments of the web 18. The jets of fluid also drive fibers into and through the web 18 to form a composite material 46. The hydraulic entangling may take place while the fiber layer 10 is highly saturated with water. For example, the fiber layer 10 may contain up to about 90 percent by weight water just before hydraulic entangling. Alternatively, the fiber layer may be an air-laid or dry-laid layer of pulp fibers.

The hydraulic entangling may be accomplished utilizing conventional hydraulic entangling equipment such as may be found in, for example, in U.S. Pat. No. 3,485,706 to Evans, the disclosure of which is hereby incorporated by reference. The hydraulic entangling of the present invention may be carried out with any appropriate working fluid such as, for example, water. The working fluid flows through a manifold 28 that evenly distributes the fluid to a series of individual holes or orifices. These holes or orifices may be from about 0.003 to about 0.015 inch in diameter. The invention may be practiced utilizing any manner of conventionally available manifold. Suitable devices are manufactured by Reiter Perfojet of France, and Fleissner of Germany. Various manifold configurations and combinations may be used. For example, a single manifold may be used or several manifolds may be arranged in succession.

In the hydraulic entangling process, the working fluid passes through the orifices at a pressures ranging from about 200 to about 6000 pounds per square inch gage (psig). At the upper ranges of the described pressures it is contemplated that the composite fabrics may be processed at speeds of about 1000 feet per minute (fpm) The fluid impacts the fiber layer 10 and the web 18 which are supported by the hydro-entangling fabric 26, which may be, for example, a single plane mesh having a mesh size of from about 8×8 to about 100×100. The fabric 26 may also be a multi-ply mesh having a mesh size from about 50×50 to about 200×200. As is typical in many water jet treatment processes, vacuum slots 30 may be located directly beneath the hydro-needling manifolds 28 or beneath the entangling fabric 26 downstream of the manifolds 28 so that excess water is withdrawn from the hydraulically entangled composite material 46.

Figure 3:
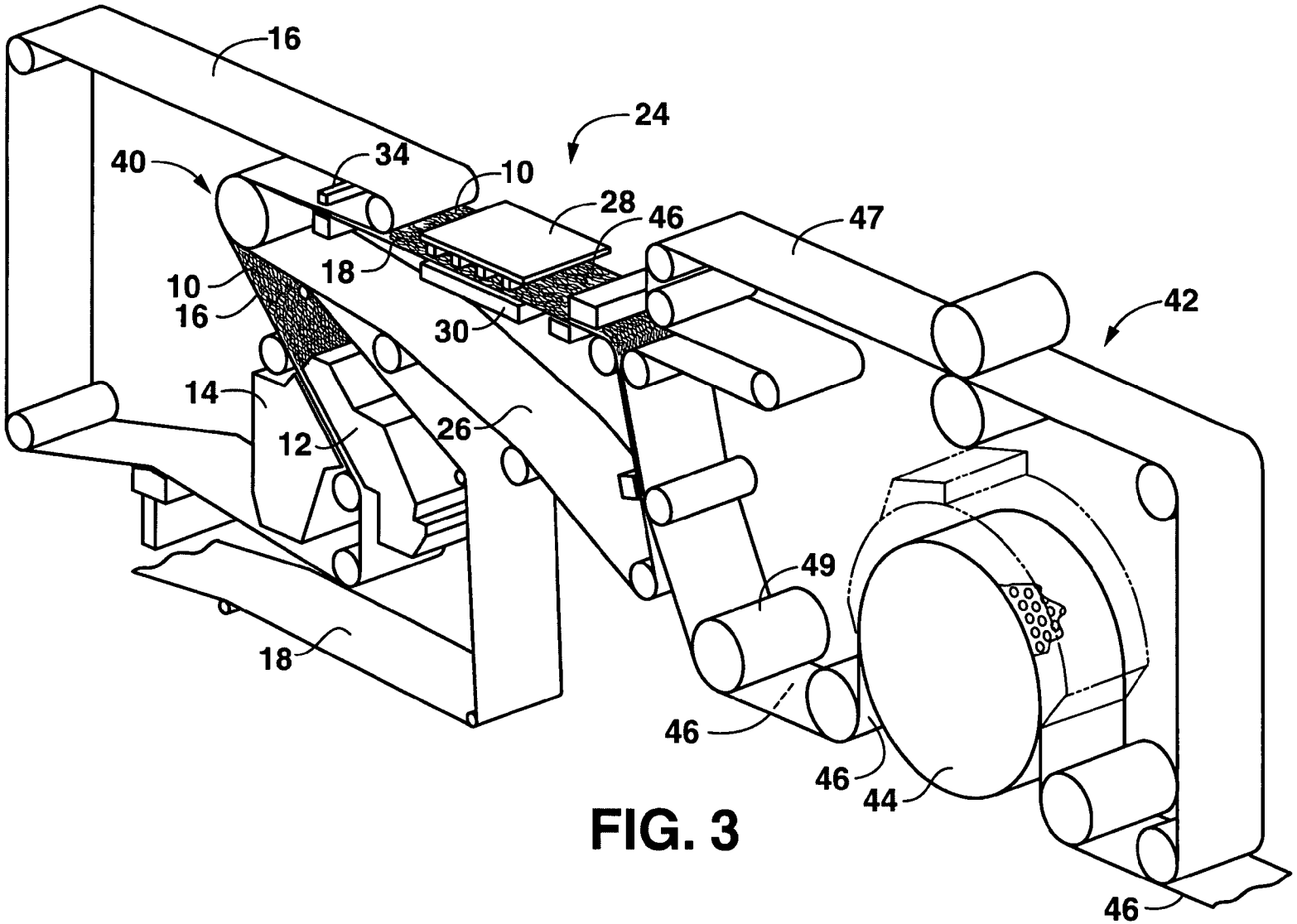
FIG. 3 is a perspective view of an alternate manufacturing line incorporating aspects of the process according to the invention.

From the hydro-entangling station 24, the composite material 46 is conveyed to any manner of drying station 42, which typically includes a non-compressive dryer, such as a conventional rotary drum through-air dryer 44 as shown in FIGS. 1 and 3. The through-air dryer 44 may include an outer rotatable cylinder with perforations in combination with an outer hood for receiving hot air blown through the perforations. A belt 47 carries the composite material 46 over the upper portion of the through-air dryer outer cylinder where the heated air forced through the perforations in the outer cylinder removes water from the composite material 46. The temperature of the air forced through the composite material 46 may range from about 200 degrees to about 500 degrees F. Other useful through-drying methods and apparatus may be found in, for example, U.S. Pat. Nos. 2,666,369 and 3,821,068, the contents of which are incorporated herein by reference.

In the embodiment of FIG. 1, the composite material 46 is diverted from the hydro-entangling fabric 26 by any manner of diverting device (i.e., roll, blower, transfer belt, etc.) schematically illustrated as element 22 and transferred unsupported from the hydro-entangling station 42 to the drying station 42 where it is eventually transferred to the dryer belt 47. The composite material 46 has sufficient strength and integrity after the hydro-entangling process to be conveyed in this manner. In certain situations, however, it may be desired to support the composite fabric 46 up to and through the drying station 42. For example, FIG. 3 illustrates an embodiment wherein a differential speed pickup roll 49 is used to transfer the material 46 from the hydro-entangling fabric 26 to the dryer belt 47. Alternatively, conventional vacuum-type pickups and transfer fabrics may be used. If desired, the composite fabric may be wet-creped before being transferred to the drying operation.

It may be desirable to use finishing steps and/or post treatment processes to impart selected properties to the composite material 46. For example, the material 46 may be lightly pressed by calender rolls, creped, or brushed to provide a uniform exterior appearance and/or certain tactile properties. Alternatively and/or additionally, chemical post-treatments such as, adhesives or dyes may be added to the material.

Additionally, the material may contain various materials such as, for example, activated charcoal, clays, starches, and superabsorbent materials. For example, these materials may be added to the suspension of fibers used to form the fiber layer 10. These materials may also be deposited on the fiber layer prior to the fluid jet treatments so that they become incorporated into the composite fabric by the action of the fluid jets. Alternatively and/or additionally, these materials may be added to the composite material 46 after the fluid jet treatments. If superabsorbent materials are added to the suspension of fibers or to the fiber layer before water-jet treatments, it is preferred that the superabsorbents are those that remain inactive during the wet-forming and/or water-jet treatment steps and can be activated later.

As mentioned, the process according to the invention offers distinct advantages by completely supporting the fiber layer 10 from below from formation of the fiber layer 10 at the head box 12 until the fiber layer 10 is transferred to the web 18 and conveyed together through the hydro-entangling station 24. Referring to FIGS. 1 and 2 in particular, a machine configuration embodiment is depicted for achieving the purpose of the present inventive process. The traveling path of the forming fabric 16 upon which the fiber layer 10 is deposited converges with the path of the hydro-entangling fabric 26 at combining location 40. From this location, the web 18 and fiber layer 10 travel adjacent each other over a defined distance with the fiber layer 10 and web 18 sandwiched between the forming fabric 16 and the hydro-entangling fabric 26. In the illustrated embodiment, the combining location 40 is defined by a combining roll 36 around which the forming fabric 16 and hydro-entangling fabric 26 run (at least partially) in their traveling path.

Because of the change in traveling direction of the fabrics 10, 26 prior to the sandwiched material layers reaching the hydro-entangling station 24, the fabrics 16, 26 re-orient such that the fabric 16 is above the fiber layer 10 and the fabric 26 fully supports the web 18 and fiber layer 10 from below. The forming fabric 16 is separated from the fiber layer 10, but not before the fiber layer is fully supported from below by the web 18 and the hydro-entangling fabric 26. The forming fabric 16 may be separated from the fiber layer 10 by various means. In the illustrated embodiment, the traveling path of the forming fabric 16 is diverted away from the fiber layer 10 by roller 35. It may be desired to include a vacuum source applied through the hydro-entangling fabric 26 to draw the fiber layer 10 against the web 18 as the forming fabric 16 is diverted away. For example, referring to FIG. 1, a vacuum box or slot 32 is disposed below the hydro-entangling fabric 26 between the combining roll 36 and the hydro-entangling station 28. It may also be desired to include a hydro-entangling manifold 34 in combination with the vacuum source 32 to aid in separation of the fiber layer 10 from the forming fabric 16. The manifold 34 may include one or more water jets that impinge against the upper surface of the forming fabric 16 causing the fiber layer 10 to release from the opposite side of the fabric 16. This manifold 34 may also result in a beneficial degree of pre-entangling of the pulp fibers from the fiber layer 10 into the web 18 prior to the hydro-entangling station 24.

In a particular embodiment as illustrated in the figures, the web 18 is directed against the hydro-entangling fabric 26 at a location where the hydro-entangling fabric 26 travels in a direction other than the machine direction. For example, referring to FIG. 1, the web 18 is directed against the hydro-entangling fabric 26 at an underside of the traveling loop of the fabric 26 prior to the fabric changing direction at the combining roll 36. The combining location 40 where the forming fabric 16 converges with the hydro-entangling fabric 26 is at or before the location where the fabrics 26, 16 change direction to the machine direction, as seen in FIGS. 1 and 2. As mentioned, with this configuration, the relative position of the forming fabric 16 with respect to the fiber layer reverses such that the forming fabric moves from a position wherein it fully supports the fiber layer 10 from below to a subsequent position wherein it is disposed above the fiber layer 10, but not before the fiber layer 10 is fully supported by the nonwoven web 18 and hydro-entangling fabric 26. The forming fabric 16 and hydro-entangling fabric 26 may travel together a defined a distance with the fiber layer 10 and nonwoven web 18 sandwiched therebetween. For example, referring to FIG. 1, this distance is defined between the combining roll 36 and diverting roll 35. This distance need only be sufficient to reorient the relative position of the forming fabric 16 and hydro-entangling fabric 26 prior to diverting the forming fabric 16 away from the fiber layer 10.

The fiber layer 10 may be deposited onto the forming fabric 16 at a location below the combining location 40 such that the fiber layer 10 is fully supported from below by the forming fabric 16 and is conveyed at an angle in a vertical direction up to the combining location 40. At the combining location 40, the fiber layer 10 is placed against the nonwoven web 18 and the combination of the materials is sandwiched between the forming fabric 16 and hydro-entangling fabric 26. Thus, it should be appreciated that the relative position of the head box 20 and traveling path of the forming fabric 16 may vary with respect to the path of the hydro-entangling fabric 26 and location on the fabric 26 where the nonwoven web 18 is introduced so long as the relative positions result in the fiber layer 10 and nonwoven web 18 being sandwiched between the forming fabric 16 and hydro-entangling fabric 26. From this point, the relative positions of the forming fabric 16 and hydro-entangling fabric 26 may be changed, for example as they travel at least partially around the combining roll 36 at the combining location 40, so that the web 18 and fiber layer 10 become fully supported from below by the hydro-entangling fabric 26.

Referring to FIG. 1, once the composite material 46 has been dried at the drying station 42, the material 46 is conveyed to any manner of conventional take-up station 48 that may include any manner of winder 50 for winding the composite material 46 into rolls. Alternatively, the material 46 may be conveyed directly to a manufacturing line wherein the material 46 is used in the manufacture of any manner of article, such as a disposable absorbent article.

FIG. 3 illustrates a manufacturing line that also incorporates aspects of the present inventive process. As mentioned, in this particular line, the material 46 is conveyed to the dryer belt 47 by way of a differential speed pick-up roll 49.

Figure 4:
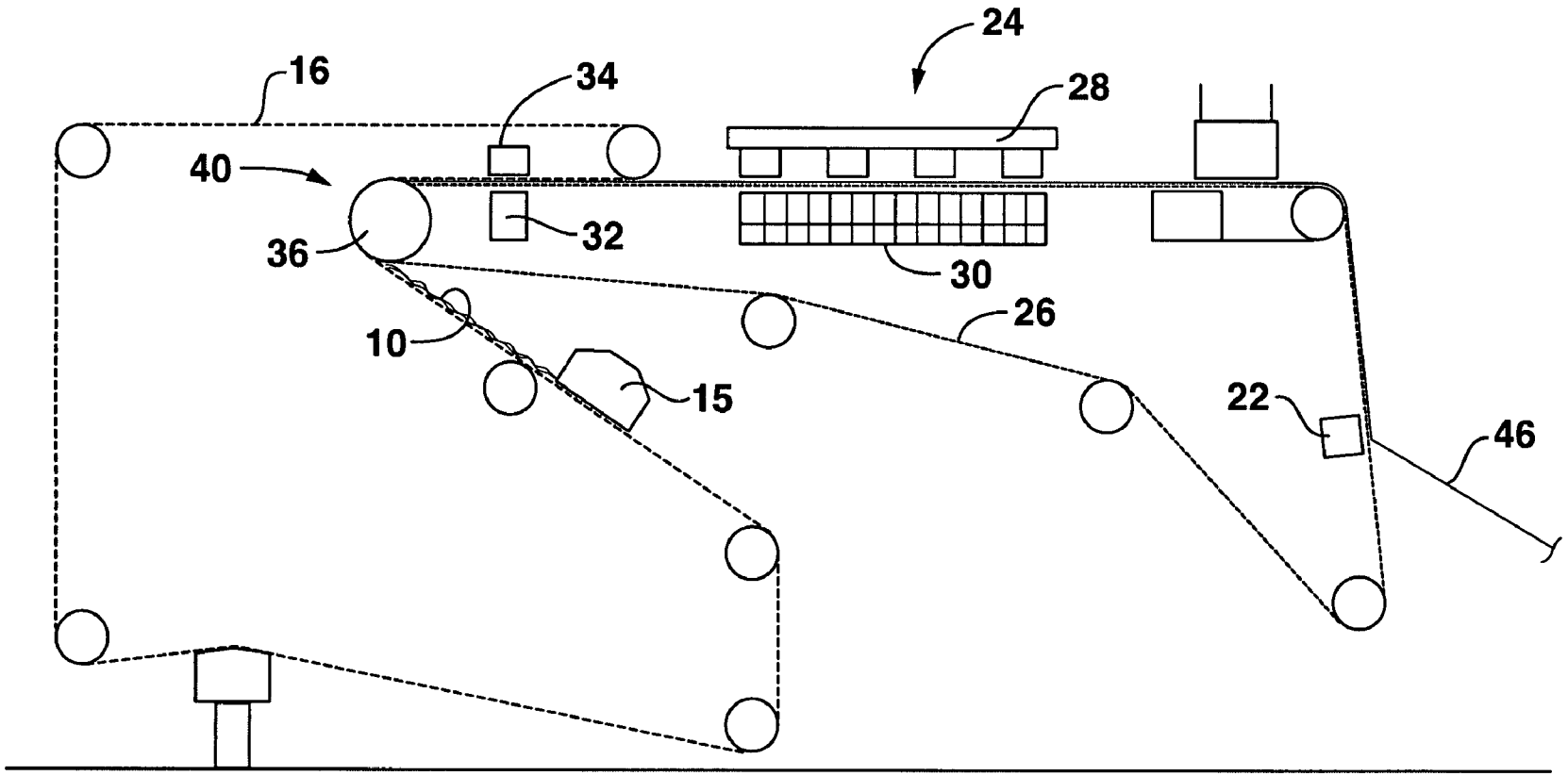
FIG. 4 is a perspective view of an alternate configuration according to the invention for transferring a fiber layer from a first traveling belt to a second traveling belt.

Embodiments of the present inventive process are not limited to hydro-entangling lines, but may be used to transfer a fiber layer or other inherently weak web from one traveling belt to another for any desired purpose. For example, referring to FIG. 4, a fiber layer 10 is transported by a first belt (i.e., a forming belt 16) and is conveyed to a second belt (i.e., a hydro-entangling fabric 26) for any further desired processing step. In the illustrated embodiment of FIG. 4, the fiber layer 10 may be deposited directly onto the first belt from a die head 15 as a series of continuous filament fibers in a spunbonding process, or as staple length fibers as in a melt-blowing process. The fiber layer on the first belt 16 merges with second belt 26 at the converging location 40, which may include a combining roller 36. After the belts re-orient such that the fiber layer 10 is supported completely from below by the second belt 26, the first belt, 16 is diverted away and removed from the fiber layer 10, as discussed above. The fiber layer 10 is then conveyed by the second belt 26 for further processing. In the illustrated embodiment, the fiber layer 10 is conveyed to an entangling station 24.

It should be appreciated by those skilled in the art that various modifications and variations can be made to the embodiments of the process described and illustrated herein without departing from the scope and spirit of the invention. It is intended that such modifications and variations are encompassed by the appended claims and their equivalents.

What is claimed is:

1. A process for hydro-entangling a layer of fibers into a web, said process comprising:

conveying a web to lie against a traveling hydro-entangling fabric;

depositing a layer of fibers onto a traveling forming fabric, the forming fabric supporting the fiber layer from below;

converging the forming fabric and the hydro-entangling fabric at a combining location where the forming fabric and hydro-entangling fabric orient and travel adjacent each other in a machine direction along a defined distance after the combining location such that the fiber layer and web are sandwiched between the forming fabric and the hydro-entangling fabric along the defined distance with the fiber layer supported from below by the hydro-entangling fabric and web;

separating the forming fabric from the fiber layer after the defined distance and the web and overlying fiber layer are supported by the hydro-entangling fabric; and conveying the hydro-entangling fabric through a hydro-entangling station to hydro-entangle the fibers into the web.

2. The process as in claim 1, wherein the web is directed against the hydro-entangling fabric at a location where the hydro-entangling fabric travels in a direction other than the machine direction.

3. The process as in claim 2, wherein the combining location of the forming fabric and hydro-entangling fabric is at or before the location where the hydro-entangling fabric changes direction to the machine direction.

4. The process as in claim 3, wherein the combining location of the forming fabric and hydro-entangling fabric is at a combining roll around which the forming fabric and hydro-entangling fabric are conveyed.

5. The process as in claim 1, wherein the forming fabric is separated from the fiber layer by diverting the direction of travel of the forming fabric away from the hydro-entangling fabric.

6. The process as in claim 5, further comprising applying a suction through the hydro-entangling fabric with a vacuum source to adhere the fiber layer against the web before or during separation of the forming fabric from the fiber layer.

7. The process as in claim 6, further comprising use of a hydro-entangling manifold in combination with the vacuum source to aid in separation of the fiber layer from the forming fabric.

8. The process as in claim 1, further comprising de-watering the fiber layer prior to the combining location.

9. A process for hydro-entangling a layer of fibers into a web, said process comprising:

conveying a web to lie against a traveling hydro-entangling fabric;

depositing a layer of fibers onto a traveling forming fabric, the forming fabric supporting the fiber layer from below:

converging the forming fabric and the hydro-entangling fabric at a combining location where the forming fabric and hydro-entangling fabric orient and travel adjacent each other such that the fiber layer and web are sandwiched between the forming fabric and the hydro-entangling fabric with the fiber layer supported from below by the hydro-entangling fabric and web;

separating the forming fabric from the fiber layer after the web and overlying fiber layer are supported by the hydro-entangling fabric; and conveying the hydro-entangling fabric through a hydro-entangling station to hydro-entangle the fibers into the web; and wherein the fiber layer is deposited onto the forming fabric at a location below the combining location such that the fiber layer is supported from below and conveyed by the forming fabric up to the combining location.

10. The process as in claim 9, wherein the forming fabric and hydro-entangling fabric travel around a combining roll at the combining location and travel together in a machine direction along a defined distance with the fiber layer and web sandwiched therebetween.

11. A process for hydro-entangling a layer of fibers into a web, said process comprising:

conveying a web to lie against a traveling hydro-entangling fabric;

conveying a layer of fibers on a first traveling belt, the fiber layer fully supported from below by the first belt;

orienting the direction of travel of the first belt with respect to the hydro-entangling fabric so as to transfer the fiber layer from the first belt to overlie the web on the hydro-entangling fabric at a transfer location;

conveying the web and fiber layer through a hydro-entangling station to hydro-entangle the fibers into the web; and wherein the fiber layer is deposited onto the first traveling belt at a location below the transfer location such that the fiber layer is supported from below and conveyed by the forming fabric up to the transfer location.

12. The process as in claim 11, wherein the first traveling belt is a forming fabric that converges with the hydro-entangling fabric where the fiber layer is transferred to overlie the web, the forming fabric re-orienting so as to be disposed above the fiber layer after the fiber layer is supported from below by the web.

13. The process as in claim 12, wherein the forming fabric conveys the fiber layer to the hydro-entangling fabric from a location forward of the convergence location with respect to a processing machine direction.

14. The process as in claim 12, wherein the forming fabric is diverted away from the hydro-entangling fabric after the convergence location and before the hydro-entangling station.

15. The process as in claim 14, wherein the forming fabric and hydro-entangling fabric travel adjacent each other over a defined distance prior to separation of the forming fabric from the fiber layer, the fiber layer and web sandwiched between the forming fabric and hydro-entangling fabric over the defined distance.

16. The process as in claim 14, wherein the hydro-entangling fabric is conveyed over a vacuum source after the fiber layer is transferred onto the web to aid in separation of the forming fabric from the fiber layer.

17. The process as in claim 16, further comprising use of a hydro-entangling manifold in combination with the vacuum source to aid in separation of the fiber layer from the forming fabric.

18. The process as in claim 17, further comprising dewatering the fiber layer prior to the transferring the fiber layer to overlie the web.

19. A process for conveying a fiber layer between processing stations, said process comprising:

conveying a layer of fibers on a first traveling belt, the fiber layer supported from below by the first belt;

converging the first traveling belt with a second traveling belt at a combining location where the first belt and second belt merge such that the fiber layer is sandwiched between the first belt and second belt;

re-orienting the relative position of the merged first and second belts such that the second belt is disposed below the fiber layer;

separating the first belt from the fiber layer after the fiber layer is fully supported from below by the second belt;

wherein the merged first and second belts are conveyed over a vacuum source to aid in separation of the first belt from the fiber layer; and further comprising use of hydro-entangling manifold in combination with the vacuum source to aid in separation of the fiber layer from the first belt.

20. The process as in claim 19, wherein, after merging, the first and second belts travel adjacent each other for a defined distance with the fiber layer sandwiched therebetween prior to separating the first belt from the fiber layer.

21. The process as in claim 19, wherein the first belt conveys the fiber layer from a location below and forward of the convergence location with respect to a processing machine direction.

22. The process as in claim 19, wherein the first belt is separated from the fiber layer by diverting the traveling direction of the first belt away from the second belt.

23. The process as in claim 19, further comprising conveying the fiber layer on the second belt to a hydro-entangling station wherein the fibers on the second belt are entangled.

* * * * *